US005862982A

United States Patent [19]

Federspiel

[11] Patent Number: 5,862,982

[45] Date of Patent: Jan. 26, 1999

[54] OPTIMAL VENTILATION CONTROL STRATEGY

[75] Inventor: Clifford C. Federspiel, Shorewood, Wis.

[73] Assignee: Johnson Service Company, Milwaukee, Wis.

[21] Appl. No.: 936,451

[22] Filed: Sep. 24, 1997

[51] Int. Cl.[6] ..... F24F 11/00

[52] U.S. Cl. ..... 236/49.3; 165/249; 454/256

[58] Field of Search ..... 236/49.3, 44 A, 236/44 C; 454/256, 258, 239, 75, 229; 165/248, 249, 250, 251

[56] References Cited

U.S. PATENT DOCUMENTS 3,982,583 9/1976 Shavit ..... 165/249
5,464,369 11/1995 Federspiel ..... 454/256
5,520,328 5/1996 Bujak, Jr. ..... 236/49.3 X
5,742,516 4/1998 Olcerst ..... 454/256 X

*Primary Examiner*—Harry B. Tanner
*Attorney, Agent, or Firm*—Quarles & Brady

[57] ABSTRACT

The present invention provides a method of modeling multi zone ventilation systems. The method integrates flow rate standards with the concept of age of air. The method serves as the basis for several different ventilation effectiveness calculation methods, and for translating outdoor air requirements to age of air requirements, and vice versa. The method also serves as the basis for the development of new ventilation strategies for multi zone systems that minimizes the amount of outdoor air required to maintain the age of the zone air at or below a maximum acceptable level. Preferably, the ventilation control strategy of the present invention allows age of air in each of a plurality of zones in a multi-zone system to conform to ASHRAE Standard 62 requirements.

18 Claims, 4 Drawing Sheets

OPTIMAL VENTILATION CONTROL STRATEGY

BACKGROUND OF THE INVENTION

1. Technical Field

The present invention relates generally to ventilation control systems, and more particularly to a multi zone ventilation modeling system that integrates the ventilation control concepts of flow rate and age of air, thereby enabling the methodology to be used for ventilation control and ventilation performance evaluation, and that results in a ventilation control strategy that minimizes the amount of outdoor air required to maintain the age of air in each of the zones in a multi zone system at or below a specified age level.

2. Discussion

It is common practice to utilize ventilation strategies to control concentration of contaminants within buildings. Ventilation, which is a dilution process that involves mixing uncontaminated outdoor air with contaminated, or recycled, indoor air, allows contaminant concentrations to be maintained at or below predetermined acceptable levels. Two important variables in the ventilation process include: 1) the required quantity of uncontaminated air necessary to keep contaminant levels in the building at or below predetermined acceptable levels; and 2) the air mixing effectiveness of the building ventilation system.

ASHRAE Standard 62 provides specific guidelines for minimum acceptable ventilation system parameters. The standard describes the minimum parameters in terms of outdoor air flow rates, and, as a result, the parameters constitute constraints on the ventilation control system. When a parameter within a zone in a multi zone ventilation system reaches its maximum or minimum allowable value, the zone is referred to as a critical zone. Generally, and particularly in variable air volume (VAV) ventilation control systems, a critical zone changes dynamically.

Considerable attention has been focused on methods of meeting the minimum requirements of ASHRAE Standard 62, while using the minimum required amount of unconditioned outdoor air, as use of unconditioned outdoor air results in increased ventilation costs. Methods of meeting the requirements of Standard 62 become more complicated when multi zone systems are modeled. One conventional method of addressing the above problem is generally referred to as the Multiple Spaces Methods (MSMs). However, while Standard 62 requires compensation for poor ventilation effectiveness, which is a measure of the amount of stagnant air in a space, conventional approaches, such as MSMs, often fail to address this parameter.

While conventional MSMs exhibit adequate performance characteristics on many applications, such conventional ventilation strategies do have associated drawbacks. For instance, MSMs do not account for spaces that receive neither primary air from air and air handling units, nor secondary air from a plenum, but that do have an associated ventilation constraint. Such spaces often include bathrooms and hallways. In addition, MSM either do not calculate, or have typically have associated difficulty calculating, flow rates between zones in a multi zone system. Such flow rates, if known, could be used to decrease the ventilation requirements in the multi zone systems resulting from overventilated zones. In addition, MSMs do not account for local exhaust, such as bathroom exhaust. As almost all buildings have such local exhaust systems, it would be desirable to provide a ventilation control strategy that would account for such local exhaust. Finally, and in general, as all MSMs require the use of a certain amount of outdoor air, it is always desirable to provide a ventilation control strategy that minimizes the amount of outdoor air required, while still meeting ASHRAE Standard 62 requirements.

SUMMARY OF THE INVENTION

Accordingly, the present invention provides a strategy for modeling multi zone ventilation systems. The strategy integrates flow rate standards with the concept of age of air. The strategy serves as the basis for several different ventilation effectiveness calculation methods, and for translating outdoor air requirements to age of air requirements, and vice versa. The strategy also serves as the basis for the development of new ventilation strategies for multi zone systems. The strategy maintains ventilation zone age of air at or below a predetermined maximum allowable age, and conforms zone ventilation effectiveness to ASHRAE Standard 62 requirements.

More particularly, the present invention provides a ventilation system that includes an air handling unit that controls air flow through a plurality of ventilation zones. An ambient air input is connected to the air handling unit, and inputs a specified amount of ambient air into the air handling unit for distribution among the plurality of zones. Each of a plurality of terminal units, associated with one of the plurality of ventilation zones, includes a temperature controller programmed to control zone temperature, and a ventilation controller that controls zone age of air. The temperature controller and the ventilation controller are programmed to function independently of each other and to minimize the amount of ambient air required to maintain the age of air in the plurality of zones at or below a predetermined level.

Also, the present invention provides a method of modeling a multi zone ventilation system, comprising the steps of modeling age of air at a ventilation zone location; setting an air flow rate in the ventilation zone location so that the age of air at the zone location is maintained at or below a predetermined level; minimizing the amount of ambient air required to maintain the age of air at or below the predetermined level; and maintaining temperature within the ventilation zone at a predetermined temperature. The steps of setting air flow rate and maintaining temperature are mutually exclusive and are performed independently from one another.

DETAILED DESCRIPTION OF THE PREFERRED EMBODIMENTS

Figure 1:
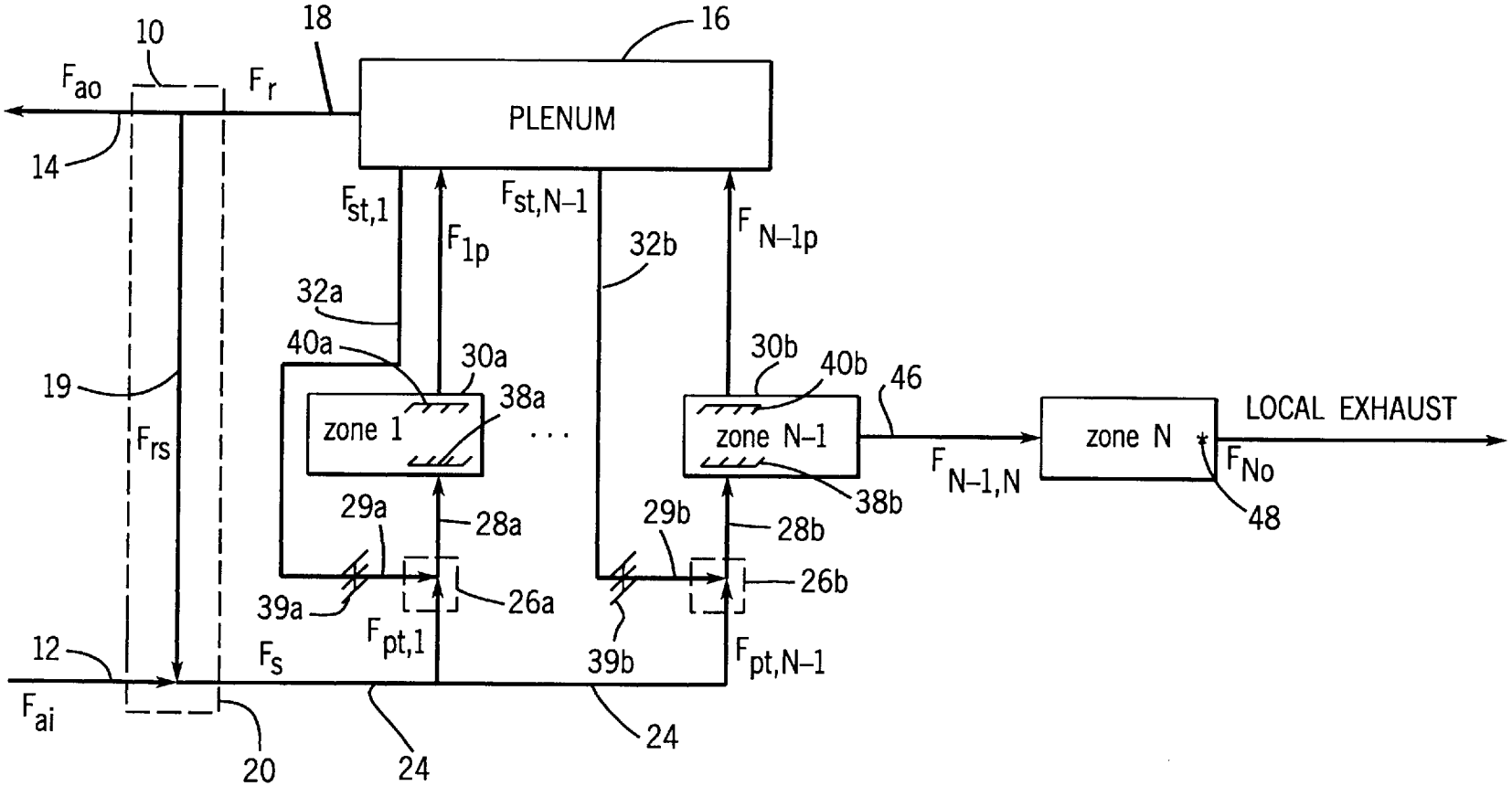
FIG. 1 is a block schematic diagram of a multi zone ventilation system in which the ventilation control strategy according to the present invention is implemented.

Referring to the drawings, FIG. 1 is a schematic diagram of a multi zone ventilation system, such as that typically found in present-day commercial buildings. The system includes an air handling unit 10. The air handling unit 10 is preferably a conventional HVAC unit that conditions air in a plurality of ventilation zones, such as zone 1, zone N-1 and zone N as shown. The air handling unit 10 controls both air flow through the zones and temperature of the air in the zones, as will be described in more detail below. The air handling unit 10 has both an ambient air inlet 12 for intake of outdoor ambient air having an associated flow rate $F_{ai}$ and an ambient air outlet 14 for exhausting air returned from the multiple zones through plenum 16 and unit return duct 18.

Figure 2B:
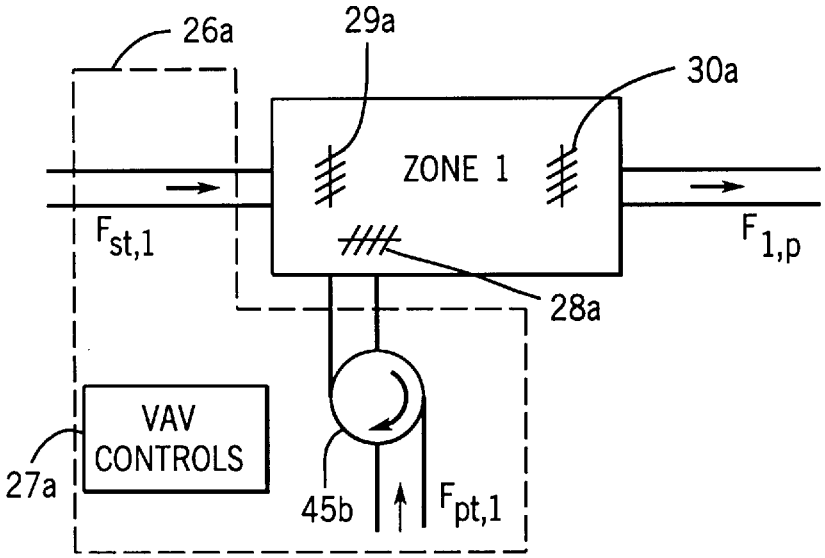
FIG. 2B illustrates a second air recirculation strategy associated with each of the zone terminal units of FIG. 1.

The air handling unit 10 conditions return supply air, having a flow rate $F_{rs}$, through a flow path 19 and combines the conditioned return supply air with ambient air, having an associated flow rate $F_{ai}$. The unit outputs the combined conditioned supply air, having a flow rate $F_s$, at unit output 20. The conditioned air supply flows through duct work 24, which, along with flow path 19, comprises a primary recirculation path, into both zone 1 and zone N-1. The conditioned air, which has flow rates $F_{pt,1}$ and $F_{pt,\ N-1}$, respectively, in each of the zones, flows through the duct work 24 into each of the zones through zone terminal units 26*a*, 26*b*. Each of the terminal units is preferably a variable air volume (VAV) control unit that includes associated controls, such as VAV controls 27*a*, associated with terminal unit 26*a* shown in FIGS. 2A–2B. Each of the terminal units 26*a*, 26*b* also has zone air inlets 28*a*, 28*b* associated with primary recirculation paths, and zone air inlets 29*a*, 29*b* associated with secondary air recirculation paths. Air input through the inlets 28*a*, 28*b* and 29*a*, 29*b* flows out of the zones through zone air outlets 30*a*, 30*b* as the air handling unit 10 pulls aged air from the zones into the plenum 16. Air pulled from the zones through the outlets 30*a*, 30*b* is then either returned to the air handling unit 10 or recirculated through duct work 32*a*, 32*b* defining the secondary recirculation paths. Air flowing through the secondary recirculation paths has associated flow rates denoted by $F_{st,\ 1}$ and $F_{st,N-1}$.

Figure 2A:
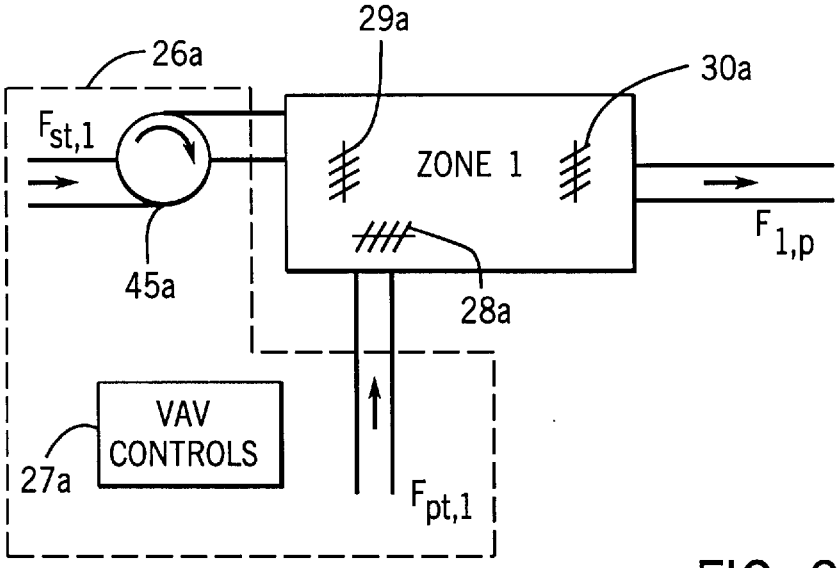
FIG. 2A illustrates a first air recirculation strategy associated with each of the zone terminal units of FIG. 1.

Each of the zone inlets 28*a*, 28*b*, 29*a*, 29*b* and zone outlets 30*a*, 30*b* includes an air flow control device, such as the dampers shown at 38*a*, 38*b*, 39*a*, 39*b* and 40*a*, 40*b*, respectively. The dampers are typically integrated as part of the zone terminal units 26*a*, 26*b*, and are controlled by the terminal unit controls. In many commercial applications, the terminal units, such as the terminal unit 26*a* shown in FIG. 2A, are parallel-powered variable air volume (VAV) control boxes including an associated fan 45*a* in the secondary recirculation path to control zone air flow. Alternatively, the terminal units, such as the unit 26*a* shown in FIG. 2B, may be series-powered units including an associated fan 45*b* in the primary recirculation path.

As shown in FIG. 1, the system also includes a remote zone N that is connected to the zone N-1 via duct work 46. The zone N is remote in that it does not have an associated terminal unit. The zone N also is not connected to the primary or secondary recirculation flow paths, and therefore its associated zone flow rate, $F_{N-1,N}$, is derived from the flow rates of zone N-1. Further, the zone N has a local exhaust fan 48, with a flow rate $F_{NO}$ associated therewith, rather than a zone outlet. Remote zones such as zone N may be included in the system model to represent remote building zones such as bathrooms and hallways. As will be explained, the ventilation control strategy of the present invention accounts not only for zones associated with primary and secondary recirculation paths, but also for remote zones, such as zone N, which are typically not taken into consideration by conventional ventilation control and modeling strategies.

Figure 3:
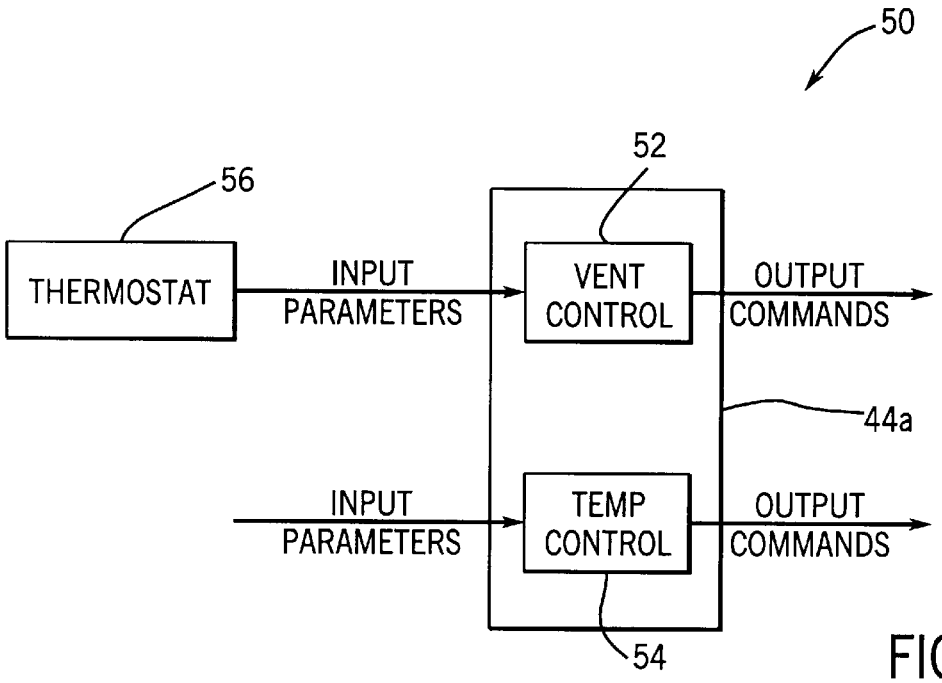
FIG. 3 is a diagram illustrating the variable inputs, and resulting outputs, of ventilation control strategy of the present invention.

Referring to the diagram of the terminal unit 26*a* shown in FIG. 3, with the understanding that the terminal unit 26*b* is identical in structure and function, the relationship of control inputs versus control outputs is shown generally at 50. The terminal unit includes both a ventilation controller 52 that controls the age of air in the zone, and a temperature controller 54 that controls zone air temperature. Input parameters for the temperature controller are received from a conventional thermostat 56 located within the zone. Input parameters for the ventilation controller are received from measurement devices (not shown) strategically placed within the zone as is well known in the art.

Figure 4:
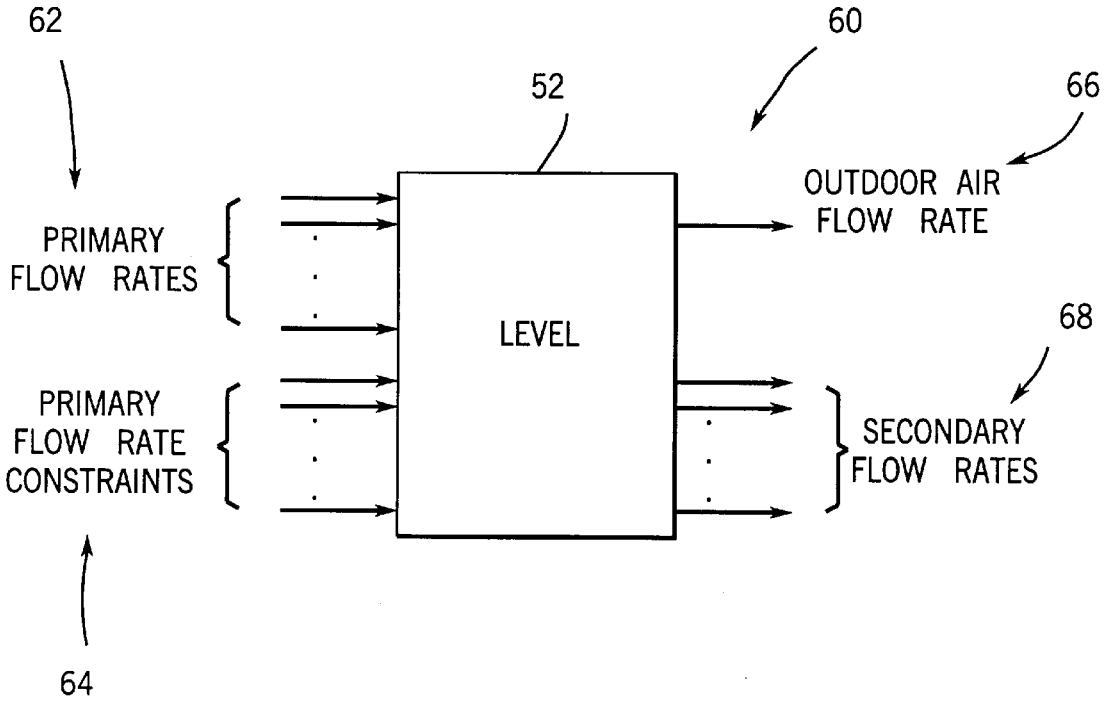
FIG. 4 is a diagram illustrating the input parameters and the output parameters associated with the ventilation controller shown in FIG. 3.

FIG. 4 illustrates both the inputs and the outputs of the ventilation controller generally at 60. Preferably, the input parameters include zone primary flow rate data, as indicated at 62, and primary flow rate constraints, as indicated at 64. The ventilation controller is programmed to generate output parameters, including outdoor air flow rate control signals 66 and secondary flow rate control signals 68, in response to the input parameters 62, 64.

In general, outdoor air is not directly supplied to any of the zones in a building. Therefore, the outdoor air flow must be interpreted as "effective" outdoor air flow rates by the following definition:

$$F_i \equiv \frac{M_i}{\bar{a}_i} \tag{1}$$

where $F_i$ is the effective outdoor flow rate to the $i^{th}$ zone, $M_i$ is the mass of the $i^{th}$ zone, and $\bar{a}_i$ is the volumetric average of the age of air in the $i^{th}$ zone. Equation 1 allows for the conversion of minimum outdoor air rates to maximum age of air.

Referring again to FIG. 1, equations for determining the age of air at any point in the system are given below. The equations are based on results from conventional temporal mixing theory, as is well known to those skilled in the art. A sufficient condition for this theory to be valid is that the residence time distributions of each chamber are independent. However, it is not necessary. It is normally satisfied by HVAC systems.

Air accumulates age in chambers. The relation between the incoming air age and the outgoing air age for a chamber with m inputs and n outputs is as follows:

$$\frac{\sum_{k=1}^{n} F_{ek}a_{ek}}{F} = \frac{\sum_{k=1}^{m} F_{ik}A_{ik}}{F} = \frac{M}{F} \tag{2}$$

The subscripts e and i refer to exit and inlet, respectively. M refers to the mass of air. Equation 2 states that the flow-weighted average of the outgoing age $$F = \sum_{k=1}^{n} F_{ek} = \sum_{k=1}^{m} F_{ik} \tag{3}$$

is equal to the flow-weighted average of the incoming age plus the age accumulation. For a chamber with just one input and one output, Equation 2 becomes the following:

$$a_e = a_1 + \frac{M}{F} \tag{4}$$

Age is distributed at points where two ducts converge into one or one duct diverges into two. Where the ducts diverge, the ages in the branches downstream equal the age in the branch upstream. Where the ducts converge, the relation between the ages upstream and the age downstream as follows:

$$(F_1+F_2)a_d=F_1a_1+F_2a_2 \tag{5}$$

The subscripts 1 and 2 refer to the upstream branches, and the subscript d refers to the downstream branch. In other words, the age downstream is the flow-weighted average of the ages upstream.

Ventilation (or air-change) effectiveness of a zone is a measure of the stagnation in the zone. Additional calculation methods are described below. For a chamber with m inputs and n outputs, the air-change effectiveness may be computed as follows:

$$\epsilon = \frac{\sum_{k=1}^{n} F_{ek}a_{ek} - \sum_{k=1}^{m} F_{ik}a_{ik}}{2\left(F\bar{a} - \sum_{k=1}^{m} F_{ik}a_{ik}\right)} \tag{6}$$

The factor of two is included so that the age accumulation is compared with what is theoretically the least possible accumulation. For a chamber with just one input and one output, Equation 6 becomes the following:

$$\epsilon = \frac{a_e - a_i}{2(\bar{a} - a_i)} \tag{7}$$

The zone air-change time is defined as follows:

$$T \equiv M/F \tag{8}$$

The following two alternatives to Equation 7 are derived by combining Equation 4, 7, and 8:

$$\epsilon = \frac{T}{2(\bar{a} - a_i)} \tag{9}$$

Equation 9 may be a useful calculation method when the age of the air leaving the chamber cannot be measured, and Equation 10 may be useful when the $$\epsilon = \frac{T}{2(\bar{a} - a_e + T)} \tag{10}$$

age of the air entering the chamber cannot be determined. In either case, one would calculate T from measured values of M and F.

Equations 2–10 may be applied to each zone and duct connection of a ventilation system to model the age of air at any location in the system. This model may then be used to set flow rates so that the age of air at certain locations does not exceed a specific level.

A control strategy that is programmed into the ventilation controller 52 performs the above flow rate control through use of the least possible amount of outdoor air. This control strategy will be referred to as the LEast VEntilation Load (LEVEL) control strategy. It can make use of primary and secondary recirculation flows in fan-powered VAV boxes, such as those shown in FIGS. 2A–2B, when the zone air flow is not constrained by the temperature controller 54, to optimize the use of outdoor air.

According to the LEVEL strategy of the present invention, each zone has two associated control constraints: a ventilation constraint and a temperature control constraint. The ventilation constraint for the $i^{th}$ zone is as follows:

$$\bar{a}_i \leq a_{max,i} \tag{11}$$

In order for the ventilation controller 52 not to interact with the temperature controller, the following equality constraint must be satisfied:

$$F_{st,i}(T_i - T_s) + F_{pt,i}(T_i - T_p) = C_i \tag{12}$$

where $T_i$ is the temperature of the ith zone, $T_s$ is the temperature of the primary supply air, and $T_p$ is the temperature of the plenum air, and $C_i$ is a "constant" that depends on the operation of the temperature controller. If $T_i = T_p$, then Equation 12 simply means that the primary flow rate may not be changed by the ventilation controller. If $T_i \neq T_p$ and Equation 12 is ignored in the implementation of LEVEL, then the ventilation and temperature controls will interact. If this interaction is not destabilizing, then under equilibrium conditions LEVEL will bring in the least amount of outdoor air that satisfies the ventilation constraints.

If Equation 12 is ignored, LEVEL may be implemented using a bisection search strategy. Each loop of the search involves the following steps. First, the strategy tries to use secondary air to make the age in each zone equal to the maximum design age for that zone. If it cannot, it sets the secondary flow rate either to zero or to the maximum for that zone, whichever is appropriate. Then the age constraints are evaluated. If the constraints are satisfied, then the estimated outdoor air flow rate is reduced. If the constraints are not satisfied, then the estimated value is increased.

Figure 5:
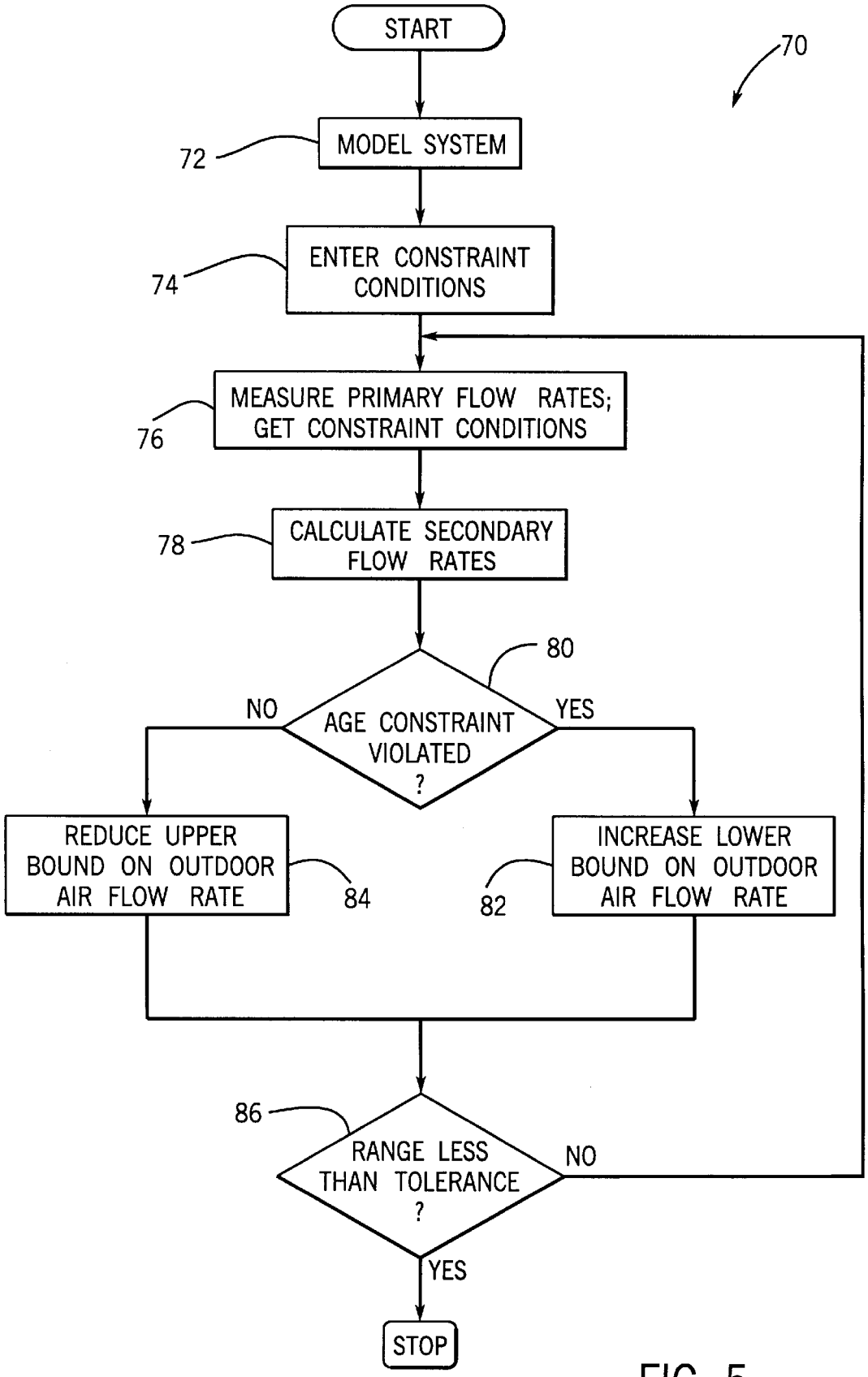
FIG. 5 is a flow diagram illustrating the methodology of the ventilation control strategy of the present invention.

Referring to FIG. 5, a flow diagram illustrating the LEVEL control strategy of the present invention is shown at 70. At 72, a model of the ventilation system under scrutiny, or that is being designed, is created, and zone and plenum volumes are specified. At 74, specific zone constraints, including upper and lower limits on ambient air flow rates, and of zone age of air limits, are input into the zone terminal units. At 76, the strategy measures primary zone flow rates. At 78, in response to the measured primary flow rates, the strategy, through the ventilation controller, calculates secondary zone flow rates required to maintain age of air in the zone, or zone location, at or below a predetermined level. At 80, the strategy determines if the age of air constraint is still violated in view of the newly calculated secondary zone flow rates. If so, at 82 the strategy increases the lower bound on the outdoor air flow rate. If not, at 84 the strategy reduces the upper bound on the outdoor air flow rate. Subsequently, at 86, the strategy determines if the range of the outdoor air flow rate is less than a predetermined tolerance level. If so, the strategy application is completed. If not, the strategy returns to 76, and steps 76–86 are repeated.

The LEVEL control strategy of the present invention will now be compared to a conventional MSM in the following example. Conventional MSMs account for, but do not control, the effects of secondary recirculation of plenum air. LEVEL controls the secondary air if it is not used by the temperature controller. In parallel fan-powered VAV boxes, the secondary air is not normally used when cooling. For this example, the volumes of each zone and the primary flow rates were chosen at random. The maximum age of air for each zone was also chosen at random. The secondary flow rate with the fan on was 1 cfm/ft$^2$, determined assuming zones are nine feet deep. The ventilation effectiveness in each zone was 0.5 (perfect mixing). The parameters used in this example are shown below in Table 1. Volumes are in ft$^3$, flow rates are in cfm, and ages are in minutes. The plenum volume is calculated assuming that the plenum is two feet deep and that the plenum area equals the sum of the areas of the zones. Since all zones are cooling, the temperature controllers don't require any secondary air. In this example there are no local exhaust and no air flow between zones.

TABLE 1

| zone | 1 | 2 | 3 | 4 | 5 | 6 | 7 | 8 | 9 | 10 | p |
|---|---|---|---|---|---|---|---|---|---|---|---|
| V | 7702 | 4003 | 9376 | 9863 | 5561 | 12573 | 12573 | 8887 | 9982 | 9524 | 20009 |
| $F_{st}$ | 526.7 | 352.3 | 960.3 | 809.0 | 150.3 | 566.8 | 1306.3 | 905.4 | 455.0 | 945.7 | — |
| $a_{max}$ | 55.7 | 43.3 | 61.3 | 62.9 | 48.5 | 71.9 | 71.9 | 59.6 | 63.3 | 61.7 | — |
| $a_{LEVEL}$ | 43.2 | 42.4 | 38.4 | 40.8 | 48.5 | 50.8 | 38.2 | 38.4 | 50.6 | 38.7 | 44.4 |
| $F_{pt,LEVEL}$ | 0 | 444.8 | 0 | 0 | 617.8 | 0 | 0 | 0 | 0 | 0 | — |
| $a_{MSM}$ | 32.5 | 29.2 | 27.6 | 30.1 | 54.8 | 40.0 | 27.5 | 27.7 | 39.8 | 27.9 | 33.6 |

The LEVEL strategy specifies 2479 cfm of outdoor air, while the MSM strategy specifies 3272 cfm, which is about 32% more. Table 1 also shows the age of air in each zone. The MSM strategy allows the age in zone five to exceed the maximum age by 13% while the LEVEL strategy ensures that the age of air in each zone is at or below the maximum design level.

The above example illustrates two important points. The first is that when secondary air is available but unused by the temperature controller, LEVEL may require less outdoor air than MSMs. The reduction in outdoor air flow rate will nearly always offset any increased cost of operating secondary recirculation fans, especially since LEVEL only operates those needed to reduce the outdoor air intake.

The other point illustrated by the example is that MSMs allow the age in some spaces to exceed the maximum design age. LEVEL does not. The reason that MSMs allow the age to exceed the maximum allowable level is that the MSMs do not explicitly account for volumes. MSMs ignore plenum volumes and all other volumes in the building with "don't care" ventilation conditions, even though these volumes accumulate age and reduce the dilution rate.

There are two other advantages of the LEVEL strategy that were not illustrated by the example. The first is that MSMs do not account for spaces that receive neither primary air from an air-handling unit nor secondary air from a plenum but that have a ventilation constraint, such as bathrooms and hallways as shown in FIG. 1 in zone N. LEVEL can account for these spaces. Flow rates between zones are often not known, and the rates are often not easily measured. However, if the rates were known, the rates could be used to decrease the ventilation requirements because sometimes over-ventilated zones help to ventilate adjacent zones.

The second advantage of LEVEL that was not illustrated by the example is that MSMs do not account for local exhaust such as bathroom exhaust. LEVEL can account for local exhaust. Virtually all buildings have local exhaust in bathrooms, so any useful ventilation control strategy should be able to account for local exhaust.

It should be appreciated upon reading of the foregoing description that the ventilation control and modeling strategy of the present invention allows a ventilation system to be designed that maintains overall ventilation of a zone without any part of the zone deviating from minimum acceptable age of air levels. The strategy is implemented to control ventilation for multiple zones through measurement of primary flow rates in combination with predetermined primary flow rate constraints, such as acceptable age of air and outdoor, or ambient, air limits. The control strategy of the present invention is also flexible, and general, enough to account for certain ventilation constraints, such as ventilation of hallways connecting zones or bathroom exhaust systems, that are not considered by conventional control strategies.

I claim:

1. A ventilation system comprising:

an air handling unit that controls air flow through a plurality of ventilation zones;

an ambient air input connected to the air handling unit that inputs a specified amount of ambient air into the air handling unit for distribution among the plurality of zones; and a plurality of terminal units, each associated with one of the plurality of ventilation zones, each of the plurality of terminal units including a temperature controller programmed to control zone temperature, and a ventilation controller that controls zone age of air;

the temperature controller and the ventilation controller being programmed to function independently of each other and to minimize the amount of ambient air required to maintain the age of air in each of the plurality of zones at or below a predetermined level.

2. The system of claim 1, further comprising a plenum operatively connected between the air handling unit and the plurality of ventilation zones that receives and mixes return air from each of the plurality of ventilation zones.

3. The system of claim 2, further comprising duct work that defines an input flow path from the air handling unit to each of the plurality of ventilation zones, a primary recirculation path between the air handling unit and each of the plurality of zones, and a secondary recirculation path between each of the plurality of zones and the plenum, the terminal unit controlling the zone temperature and the age of air through control of air circulation through both the primary and the secondary recirculation paths.

4. The system of claim 3, wherein at least one of the plurality of ventilation zones includes a local exhaust.

5. The system of claim 4, wherein each of the plurality of terminal units is programmed to account for the local exhaust in controlling the zone age of air.

6. The system of claim 3, further comprising at least one remote ventilation zone remotely connected to one of the plurality of ventilation zones via a remote zone flow path, each of the plurality of terminal units being programmed to account for the remote flow path in controlling the zone age of air.

7. The system of claim 6, wherein the remote ventilation zone includes a local exhaust, each of the terminal units being programmed to compensate for the local exhaust in controlling the zone age of air.

8. The system of claim 3, wherein each of the primary and secondary recirculation paths has an associated flow control device, controlled by the associated terminal unit.

9. The system of claim 1, wherein the temperature controller and the ventilation controller are controlled by the following equality constraint:

$$F_{at,i}(T_i-T_s)+F_{pt,i}(T_i-T_p)=C_i$$

where $T_i$ is the temperature of the ith zone $T_s$ is the temperature of the primary supply air $T_p$ is the temperature of the plenum air, and $C_i$ is a "constant" that depends on operation of the temperature controller.

10. The system of claim 1, wherein age of air in each of the plurality of ventilation zones is modeled by each of the terminal units in terms of ventilation effectiveness.

11. The system of claim 10, wherein the ventilation effectiveness is defined by the following equation:

$$\epsilon = \frac{\sum_{k=1}^{n} F_{ek}a_{ek} - \sum_{k=1}^{m} F_{ik}a_{ik}}{2\left(F\bar{a} - \sum_{k=1}^{m} F_{ik}a_{ik}\right)}$$

where $F_{ek}$=exit air flow from zone K $a_{ek}$=exit air age accumulation in zone K $F_{ik}$=input air flow in zone K $a_{ik}$=exit air age accumulation in zone K F=outdoor air flow rate $\bar{a}$=volumetric average of age of air in all zones.

12. The system of claim 10, wherein ventilation effectiveness parameters are measured at each zone inlet and outlet.

13. A method of modeling a multi zone ventilation system, comprising the steps of:

modeling age of air at a ventilation zone location;

setting an air flow rate in the ventilation zone location so that the age of air at the zone location is maintained at or below a predetermined level;

minimizing the amount of ambient air required to maintain the age of air at or below the predetermined level; and maintaining temperature within the ventilation zone at a predetermined temperature;

the steps of setting air flow rate and maintaining temperature being performed independently from one another.

14. The method of claim 13, wherein the step of modeling age of air comprises relating upstream age of air at the zone location to downstream age of air at the zone location through the following equation:

$$(F_1+F_2)a_d=F_1a_1+F_2a_2$$

where $F_1$=flow rate at first upstream location $F_2$=flow rate at a second upstream location $a_d$=volumetric average of air downstream $a_1$=volumetric age of air at the first upstream location and $a_2$=volumetric age of air at the second upstream location.

15. The method of claim 13, wherein the step of minimizing the amount of ambient air required comprises the step of utilizing conditioned recirculated air to maintain the air in the zone at or below a predetermined level.

16. The method of claim 13, wherein the steps of setting airflow rate and maintaining temperature are performed independently from one another.

17. The method of claim 16, wherein the steps of minimizing the amount of outdoor air and maintaining temperature are implemented separately from one another through the following equality constraint:

$$F_{at,i}(T_i-T_s)+F_{pt,i}(T_i-T_p)=C_i$$

where $T_i$ is the temperature of the ith zone $T_s$ is the temperature of the primary supply air $T_p$ is the temperature of the plenum air, and $C_i$ is a "constant" that depends on operation of the temperature controller.

18. The method of claim 13, further comprising the step of accounting for local exhaust in the plurality of ventilation zones.

* * * * *